US005575514A

United States Patent [19]

Troy

[11] Patent Number: 5,575,514

[45] Date of Patent: Nov. 19, 1996

[54] DOOR-HOLDING DOOR STOP

[76] Inventor: Robert F. Troy, P.O. Box 4145, Scottsdale, Ariz. 85261-4145

[21] Appl. No.: 368,858

[22] Filed: Jan. 5, 1995

[51] Int. Cl.[6] ..... E05B 15/02

[52] U.S. Cl. ..... 292/340; 292/203; 292/DIG. 19

[58] Field of Search ..... 292/340, 203, 292/DIG. 15, DIG. 19; 16/82

[56] References Cited

U.S. PATENT DOCUMENTS

| | | | |
|---|---|---|---|
| D. 251,585 | 4/1979 | Coutts | D8/402 |
| D. 253,335 | 11/1979 | Gauntner | D8/402 |
| D. 257,944 | 1/1981 | Morita | D8/331 |
| D. 259,395 | 6/1981 | Sugasawara | D8/402 |
| D. 263,558 | 3/1982 | Morita | D8/402 |
| D. 274,980 | 8/1984 | Tomita | D8/402 |
| 1,564,183 | 12/1925 | Prinzler . | |
| 1,688,221 | 10/1928 | Abbey | 292/DIG. 19 |
| 1,941,576 | 2/1934 | Phipps | 292/136 |
| 2,496,691 | 2/1950 | Berry | 292/70 |
| 2,815,236 | 12/1957 | Lowinski | 292/251.5 |
| 2,872,232 | 2/1959 | Lawson | 292/80 |
| 3,025,559 | 3/1962 | Basinger | 16/85 |
| 3,100,664 | 8/1963 | Duval | 292/251.5 |
| 3,163,453 | 12/1964 | Stephens | 292/251.5 |
| 3,243,836 | 4/1966 | Reiss | 292/DIG. 15 X |
| 3,244,443 | 4/1966 | Rodgers | 292/251.5 |
| 3,578,370 | 5/1971 | Greytok | 292/251.5 |
| 3,701,557 | 10/1972 | Centofante | 292/251.5 |
| 3,758,141 | 9/1973 | Weinberger | 292/262 |
| 4,134,608 | 1/1979 | Pool | 292/76 |
| 4,505,502 | 3/1985 | Tomita | 292/DIG. 15 X |
| 4,995,655 | 2/1991 | Freeman | 292/DIG. 19 X |
| 5,096,241 | 3/1992 | Badger | 292/288 |

*Primary Examiner*—Rodney M. Lindsey

[57] ABSTRACT

An improved door-holding door stop is provided, which is secured to a structure adjacent to a fully opened door, and has a tip of a hook-type fastening material that can be aligned at various angles in a cooperative relationship with a contributory door disk secured to a door, that has a front of a loop-type fastening material, which in combination provide a functional method of stopping and retaining a door in a fully opened position.

5 Claims, 2 Drawing Sheets

DOOR-HOLDING DOOR STOP

CROSS REFERENCES TO RELATED APPLICATIONS

Related Application

The invention of this application is related to the invention of my application Ser. No. 29/029,460, filed Oct. 6, 1994.

BACKGROUND—FIELD OF INVENTION

This invention relates to door stops and door retainers, more particularly to an improved method wherein such devices are combined effectively.

BACKGROUND—DESCRIPTION OF PRIOR ART

Interior doors, when installed in residential homes, have a tendency to become untrue due to the settlement of the house and, as a result of the force of gravity, swelling, shrinking, or the like, to self-close. When not fully closed, such doors remain in a partially open position. This situation is not only an aesthetic eyesore but a nuisance, and a potential hazard while walking through a doorway when exiting a room.

Originally a door was held in a fully open position by a wedge forced between the bottom of the door and the floor. Another original solution to the problem was a hook-and-eye hardware apparatus. Consumers objected since a wedge required bending down to place and remove the wedge. Also, a wedge is a safety hazard when not in use, and left on the floor. The hook-and-eye apparatus caused permanent defacing of a door and an abutting wall. It caused damage to a wall or door when one attempted to pull a door to close it, without the knowledge of the hook-and-eye apparatus being in use. These devices did not provide the function of a door stop.

Thereafter, inventors created several types of doorstops that had an added feature of retaining a door in a fully open position.

U.S. Pat. Des. Nos. 251,585 to Coutts (1979), 257,944 to Morita (1981), 263,558 to Morita (1982), 1,564,183 to Prinzler (1925), 1,688,221 to Abbey (1928), 1,941,576 to Phipps (1934), and 2,872,232 to Lawson (1959) disclose both floor and wall mounted door stopping and retaining devices; however, these inventions are expensive to manufacture, require contributory attachments that are recessed into, or project substantially, from a door, and are complicated to install and align to function properly. Their installation causes excessive and permanent defacing to a door, floor and/or wall due to the bolts and/or numerous screws required for installation.

These devices have a plurality of moving parts which can eventually wear and hinder proper operation, require periodic maintenance, and the additional expense of replacement. The device by Phipps and the two devices by Morita require a manual manipulation, to release them from their accompanying door attachments when closing a door.

The inventions by Prinzler and Coutts require a degree of force to engage and release the components. The resistance created by pushing or pulling a door to engage or release these devices causes the door to transmit stress and twisting to its hinges, eventually causing the hinges to twist out of shape or loosen.

Both wall and floor mounted combined door stop and latching devices are of a high cost to the consumer due to their high manufacturing expense, and are difficult to install and align for the average person. When wall mounted, they will not function unless a door is parallel to a wall in its open position so that the invention meets the door at a 90 degree angle.

The devices by Phipps and Morita require that that one be aware of, locate, and manually release the latching device to free the door in order to close it. This causes unnecessary damage to a door, a wall, and/or a floor, when one, being unaware of the installation of these devices, pulls the door while attempting to close it. There is the potential of a personal injury to a person, being unaware of their installation, pulling against the resistance of these devices to close a door.

The additional action of releasing a latch, and in the case of the floor mounted latch bending over to do so, in order to close a door can be extremely difficult for children, the physically impaired, and the elderly. Because of the necessary releasing action, people cannot close a door with the speed that they have become accustomed to.

U.S. Pat. No. 4,134,608 to Pool (1979) discloses a combination door stop and catch; however, this invention is exposed along a door's edge and the side facing a room, when the door is retained in a fully open position. It will not function unless a door is parallel to the wall in a fully open position causing the invention to meet a door at a 90 degree angle. With continued use, the device defaces the edge and side of a door facing a room, when the door is in the fully open position.

Another solution to the problem was the invention of various magnetic door stops and holders. Floor and wall mounted magnetic door stops are of a high cost to the home owner or apartment dweller due to the expense of manufacturing. Unless the door stop meets the striking plate flush they do not perform. In addition, the inherently brittle characteristic of magnets allowed them to break, or crumble when continually being impacted by the mass of a door. The impact of a door causes misalignment of rigidly mounted parts and the components of the magnetic devices create a distinctive, metal hitting metal noise, when they are forced together.

U.S. Pat. Des. No. 253,335 to Gauntner et al. (1979), 259,395 to Sugasawara (1981), 274,980 to Tomita (1984), 2,496,691 to Berry (1948), 2,815,236 to Lowinski (1957), 3,025,559 to Basinger (1959), 3,100,664 to Duval (1962), 3,163,453 to Stephens (1962), 3,244,443 to Rodgers (1966), 3,578,370 to Greytok (1971), 3,701,557 to Centofante (1972), disclose both floor and wall mounted, magnetic door stops and holders. These devices are expensive to manufacture because of their complexity, cause permanent defacing a door by requiring either nails, prongs, screws, or a combination of such, to install. With the exception of Gauntner's they are manufactured of numerous, and intricate fitting pads, which require specialized machinery to produce and assemble the devices.

The inventions by Berry, Lowinski, Duval, Stephens, Rodgers, Greytok, and Centofante comprise adjustable, moving pads that have wearing and loosening characteristics which require periodic maintenance and replacement. The combined components of the devices by Tomita, Sugasawara, Berry, Stephens, Greytok, and Centofante present a difficult task in the alignment of their components during installation.

Sugasawara's floor mounted magnetic door stop requires three wood screws to install on the floor and an additional two wood screws to install the striking plate to the door. Although this invention can be installed to meet the door at various angles, the installation to the floor and the door is difficult. This invention causes excessive damage to the door, and more specifically to the floor, due to the number of screws needed to install it.

The devices by Gauntner and Tomita must meet a door and/or striking plate flush to perform and, therefore, are not functional when the door is not parallel to a wall in a fully open position.

The prior combination door stops and holders are relatively difficult and expensive to manufacture because of their complex shapes, their pluralities of parts, and the process of manufacturing individual parts and joining them together into operable door stops.

The combination door stops and holders heretofore known suffer from a number of disadvantages:

(a) The use of magnets, moving parts, and numerous parts in the production, requires sophisticated materials, machinery, and technology.

(b) The production of the combined latching devices requires specialized machinery and/or additional manual labor for assembly, due to the moving parts.

(c) With the magnetic, the combined latching, and the door lock hook devices, the final products become very intricate for the average consumer to install correctly. They present a challenging installation for the non-mechanically minded.

(d) In the use of the floor mounted magnetic devices or combined latching devices, installation on ceramic tile, hardwood, marble, concrete and carpeted floors calls for the use of a hand, or electric, drill with specialized drill bits. The user must have both the access to these tools, and the knowledge of their use.

(e) Floor mounted devices are an obstruction to the washing or vacuuming of the floors. When installed on hard surfaced floors, it is not possible to clean around them efficiently with a mop, and one must hand-clean with a cloth or a sponge. On carpeted floors, hand cleaning or specialized attachments to a vacuum cleaner are needed for proper cleaning. They are not aesthetically pleasing in residential dwellings.

OBJECTS AND ADVANTAGES

Accordingly, several objects and advantages of my door-holding door stop are:

(a) to provide a novel and improved door-holding door stop which will prevent a door, or its installed door knob, from hitting and damaging a wall; which in combination with a retaining medium, will hold a door in the fully open position;

(b) to provide a novel and improved door-holding door stop, which comprises a tip of the hook portion of a hook-and-loop material fastening system, that affixes to a wall, and to provide a contributory novel and improved door disk, which comprises a front of the loop portion of a hook-and-loop material fastening system, that affixes to a door;

(c) to provide a novel and improved door-holding door stop which does not comprise a magnet, any moving parts, a manual tripping or releasing mechanism, and does not require sophisticated materials, machinery, and technology to manufacture;

(d) to provide a door-holding door stop which is not prohibitively expensive to manufacture resulting in an affordable item for the home owner or apartment dweller;

(e) to provide a door-holding door stop which the structure of the same can be manufactured using an inexpensive, commonly available, plastic or metal;

(f) to provide a door-holding door stop which is not commercially orientated in appearance or bulk, and is aesthetically and functionally useful with the traditional, solid wood, or hollow core wood, interior doors found in residential structures;

(g) to provide a door-holding door stop which is wall mounted, thereby eliminating any defacing or damage to the floor of the room it is installed in;

(h) to provide a novel and improved door-holding door stop which, has no adjustment mechanism, and will retain a door in its door's fully open position when the door is not parallel to a wall;

(i) to provide a door-holding door stop which requires only one screw to secure it to a wall, resulting in minimal defacing of the wall, and to provide a contributory door disk which utilizes an adhesive medium to secure it to a door, resulting in no permanent defacing to the door;

(j) to provide a door-holding door stop which can be installed without the use of electric or specialized tools;

(k) to provide a door-holding door stop which has as part of its body a hexagonal shape that can be gripped easily, with a pair of channel-lock pliers or a variety of wrenches, providing an easy, non-complicated method of installation for the average home owner, or apartment dweller;

(l) to provide a door-holding door stop which, while installing, can be easily aligned with a door disk that attaches to a door, simply by engaging the loop portion of a hook-and-loop material fastening system, affixed to the door disk, to the hook portion of a hook-and-loop material fastening system, affixed to the door stop, and gently pushing the door against it;

(m) to provide a door-holding door stop which does not require a contributory structure that must be recessed into a door;

(n) to provide a door-holding door stop which has no moving parts requiring maintenance and/or the additional expense of replacement;

(o) to provide a door-holding door stop which will not cause any defacing of a door through its continued use;

(p) to provide a door-holding door stop which through its continued use does not cause any undo stress on a door or its hinges;

(q) to provide a door-holding door stop which cannot damage a door or the door stop if a person using the door is unaware of its installation, which most guests in a residence would be;

(r) to provide a door-holding door stop which is not exposed along a door's edge or side facing a room when in the fully open position, and does not present protrusions extending from the door which can snag clothing or have a potential to cause a personal injury;

(s) to provide a novel and improved door-holding door stop which functions passively having no moving parts, and requiring no manual manipulation, thereby, allowing one to use a door with the speed that they have become accustomed to;

(t) to provide a door-holding door stop which has a retaining medium that functions passively, and quietly, to naturally release itself in response to a person pulling a door away from a wall;

(u) to provide a door-holding door stop which requires no force, and offers no resistance to a person releasing a door in order to close it, and therefore eliminating any potential for a personal injury as a result of this action;

(v) to provide a door-holding door stop which a person does not have to exert any effort or movement, such as bending over, squatting, releasing two connected parts, or releasing a device from a door, when using the door, which are difficult actions for children, the physically impaired, and the elderly;

(w) to provide a door-holding door stop which functions to release a door passively, and so easily that a person using a door would not have to be aware of its purpose;

(x) to provide a door-holding door stop which will not interfere with the vacuuming or washing of a floor;

Further objects and advantages are to provide a novel and improved door-holding door stop, and contributory door disk, which has simplicity and economy of construction to eliminate a high cost to a consumer, which eliminate a plurality of moving and adjustable parts, which eliminate the use of brittle magnets, which will not become inoperative due to loosening and/or wearing of interlocking parts, which requires no periodic maintenance or adjustments, and which offers simplicity and dependability of operation while yet providing a positive retention of a door in the open position.

Still further objects and advantages will become apparent from a consideration of the ensuing description and accompanying drawings.

REFERENCE NUMERALS

Figure 1A:
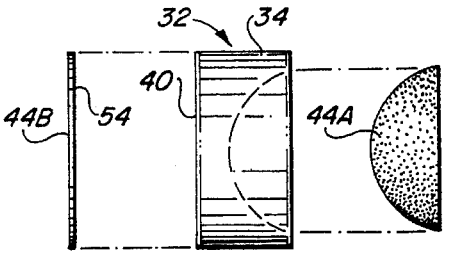
FIG. 1A is an exploded view of the door disk.

10 body of door stop
12 head
14 neck
15 flange
18 hexagonal base
20 screw
22 female threaded receptacle
24 bottom of door stop
26 male threaded base of screw
28 hook-type fastener
30 wood screw body
32 disk body
34 side of disk body
36 front rim of disk body
38 basin
40 bottom of disk body
42 loop-type fastener
44 adhesive back of hook-type fastener
44A adhesive back of loop-type fastener
44B adhesive back of disk body
46 rim of hook-type fastener
46A rim of loop-type fastener
46B rim of flange
48 tip of wood screw body
50 tip of hook-type fastener
52 orifice
54 adhesive resin

SUMMARY

A door-holding door stop comprising: a door stop body member and a contributory structure body member, a hook-and-loop type material fastening system, an attachment member for securing the body member to a wall, an attachment member for securing the contributory structure body member to a door, a head member of the body which provides a contact surface for an adhesive back of the hook-type fastening material, a basin member of the contributory structure body member which provides a contact surface for an adhesive back of the loop-type fastening material, the loop-type fastening material lining basin of the contributory structure body member being larger in diameter at its rim than the hook-type fastening material covered head of the door stop body member allowing engagement of the components of the hook-and-loop type material fastening system at various angles an infinite number of times.

PREFERRED EMBODIMENT—DESCRIPTION

Figure 7A:
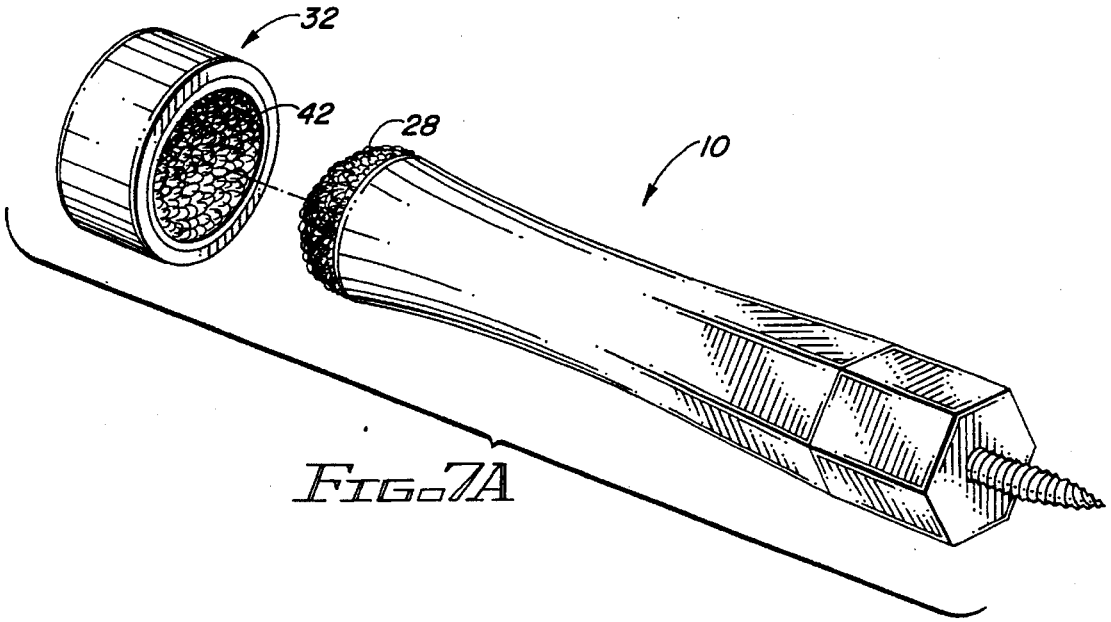
FIG. 7A shows the relationship of a hook-and-loop material fastening system prior to engagement.
Figure 7B:
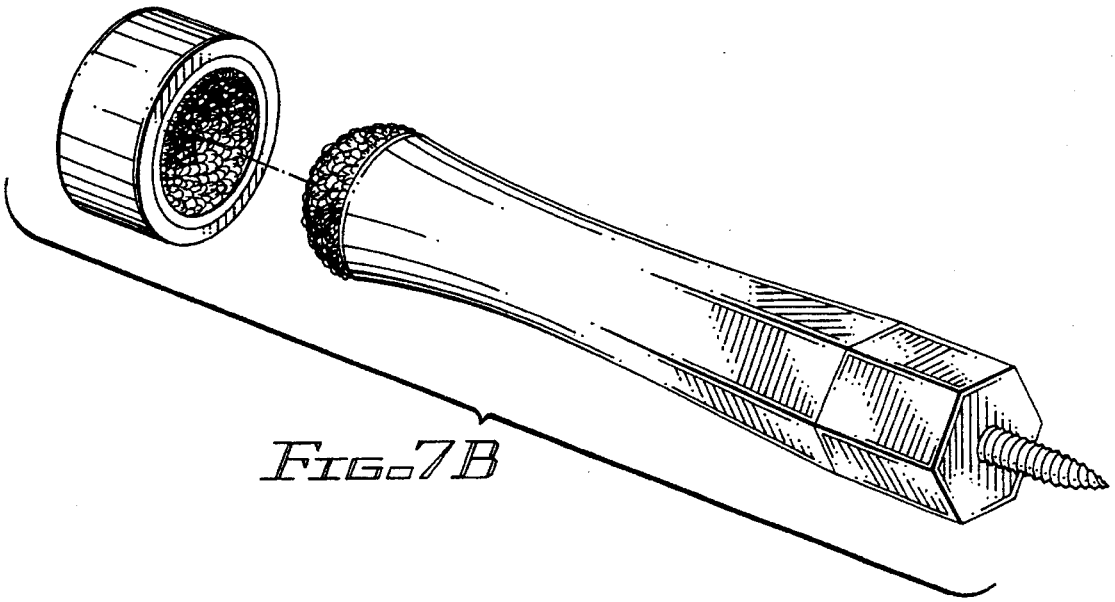
FIG. 7B is a perspective view of a door-holding door stop and door disk.

A typical embodiment of my door-holding door stop, and a typical embodiment of the contributory door disk of the present invention is illustrated in FIG. 7B.

FIG. 7A shows the basic principle of a door-holding door stop incorporating a hook-and-loop material fastening system, having a component of a hook-type fastener 28 and a component of a loop-type fastener 42 according to the present invention.

Figure 6B:
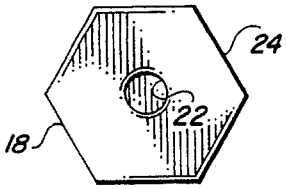
FIG. 6B is a bottom view of the door stop.
Figure 6A:
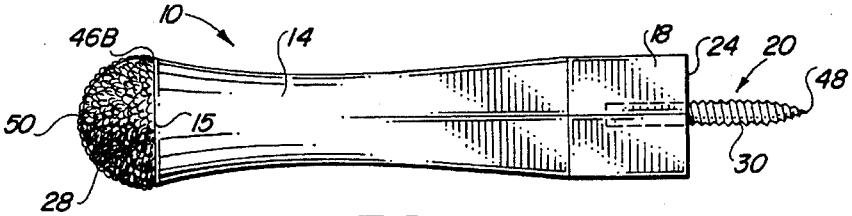
FIG. 6A is a side view of the door stop.

FIG. 6A shows a elongated door stop body 10, made of a suitable metal or plastic, which comprises a convex shaped head 12 (shown in FIG. 2A), a neck 14, a neck flange 15, a hexagonal base 18, and a door stop bottom 24 (shown in FIG. 6B) which all of the same are integral and constitute one structure. A double male threaded screw 20, made of a suitable metal, extends from and is preferably held in hexagonal base 18 with a male threaded screw base 26 (shown in FIG. 2A) which mates with a female threaded receptacle 22 (shown in FIG. 6B) centered in hexagonal base 18 at bottom 24. FIG. 6A shows a wood screw body 30 with a pointed tip 48 of screw 20 which protrudes from female threaded receptacle 22.

Figure 1B:
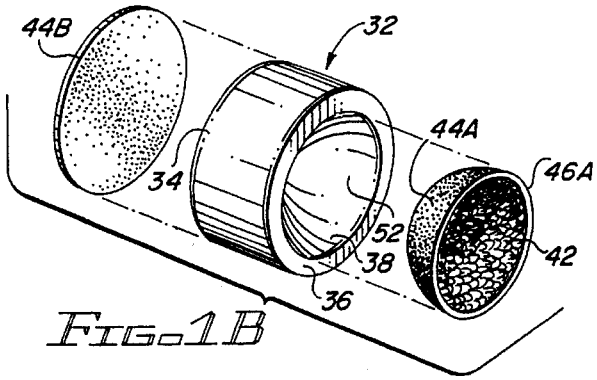
FIG. 1B is an exploded angled view of the door disk.
Figure 2A:
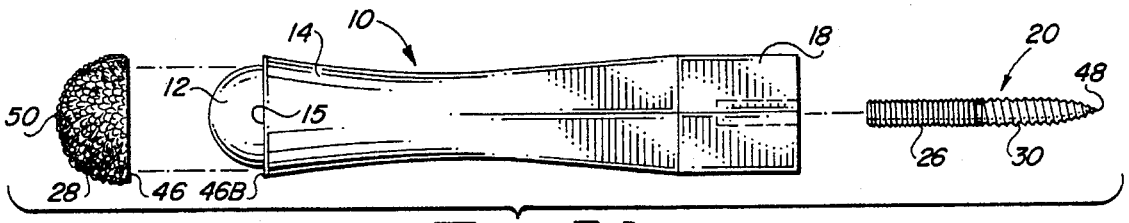
FIG. 2A is an exploded view of the door stop.
Figure 2B:
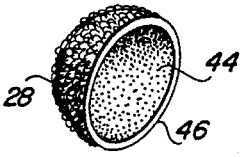
FIG. 2B is an angled view of the hook-type fastener.

FIG. 2B shows hook-type fastener 28, being convex shaped, which can be repeatedly pushed against a basin shaped loop-type fastener 42 of a door disk body 32 (shown in FIG. 1B) without loosing its fastening characteristic, that has as part of its integral structure, a adhesive back 44. FIG. 2A shows hook-type fastener 28 that envelops head 12 to the extent that a rim 46 (shown in FIG. 2B) of convex shaped hook-type fastener 28 is adjacent to a rim of flange 46B (as shown in FIG. 6A) and is preferably bonded to head 12 by adhesive back 44. Thus hook-type fastener 28 has the same shape as head 12 to which it adheres, and the entire circumference of rim 46 is adjacent to rim of flange 46B.

Figure 4:
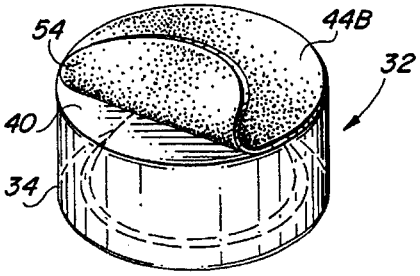
FIG. 4 shows a bottom view of the door disk with adhesive backing.
Figure 5:
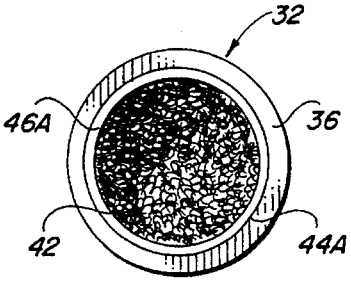
FIG. 5 is a front view of the door disk.
Figure 3:
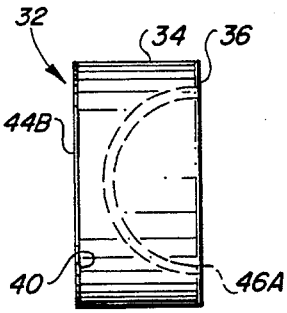
FIG. 3 is a side elevation view of the door disk.

FIG. 1B shows door disk body 32, made of a suitable metal or plastic, which comprises a side 34, a front rim 36, a basin 38, a door disk bottom 40 (as shown in FIG. 4), which all of the same are integral and constitute one structure. FIG. 1A and FIG. 4 show a door disk adhesive back 44B which is bonded to bottom 40 by a adhesive resin 54. FIG. 1B shows a basin shaped loop-type fastener 42 which can repeatedly accept hook-type fastener 28 without loosing its fastening characteristic, which has as part of its integral structure, a adhesive back 44A, lines basin 38 and is preferably bonded to basin 38 by adhesive back 44A. Thus loop-type fastener 42 has the same shape as basin 38 to which it adheres, and the entire circumference of a rim of loop-type fastener 46A is flush with front rim 36 (as shown in FIG. 3, FIG. 4., and FIG. 5.

In the preferred embodiment, door stop body 10 is a rigid plastic such as, polyethylene. However body 10 can consist of any other material that is rigid or semi-rigid when manufactured such as, various metal materials, spring formed metals, various plasticized materials, various woods, various impregnated or laminated fibrous materials, etc. Body 10 is round, tapering from flange 15 to the center and then expanding in a hexagonal shape to the hexagonal base 18, however body 10 can be of different shapes such as, straight sided, square, triangular, tapered from neck to base or from base to neck, etc. Head 12 is semi-elliptic convex shaped, however head 12, can be of different shapes such as, tubular, pointed, rectangular, mushroom, oblate, square, triangular, etc. Hook-type fastener 28 would therefore always be adapted to the shape of head 12. Hexagonal base 18 is hexagon shaped, however hexagonal base 18, can be of different shapes such as, square, octagonal, triangular etc.

Screw 20 is secured in bottom 24 with male threaded base 26 by mating with female threaded receptacle 22, however screw 20 can be manufactured as an integral part of body 10 when it is metal. When body 10 is manufactured of other materials such as, various plasticized materials, or various impregnated or laminated fibrous materials, screw 20 can be secured in hexagonal base 18 by other methods, such as hexagonal base 18 being molded around a square or T-shaped screw base.

Body 10 is secured to a wall by wood screw body 30 of screw 20, however body 10 can be secured to a wall by various other methods such as, an adhesive, a resin, a double sided tape, a silicone compound, etc.

Convex shaped hook-type fastener 28 is bonded to head 12 by adhesive back 44, however hook-type fastener 28 can be secured by other methods such as, a rivet, a number of rivets, a plastic or metal collar or O-ring, etc.

The length of body 10, extending from bottom 24 to tip of hook-type fastener 50 is typically 80 mm, which is 20 mm longer than the typical protrusion of a door knob installed on a door.

In the preferred embodiment, door disk body 32 is a rigid plastic such as, polyethylene. However body 32 can consist of any other material that is rigid or semi-rigid when manufactured such as, various metal materials, various plasticized materials, various woods, various impregnated or laminated fibrous materials, various rubber compounds, etc.

Figure 6C:
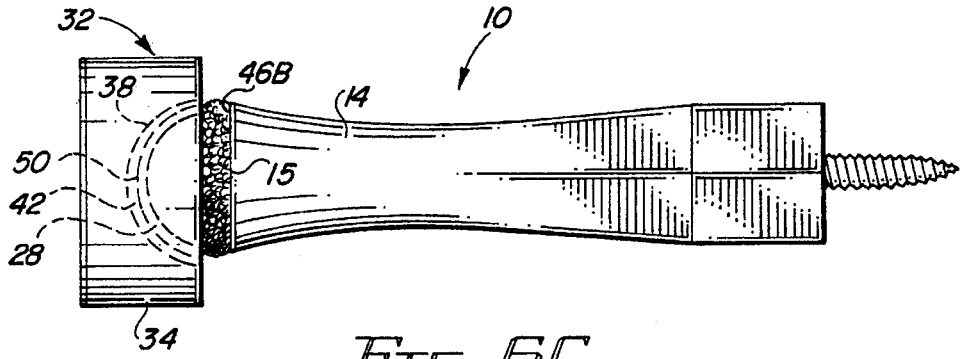
FIG. 6C shows a door stop engaged with a door disk.

Door disk body 32 is round, however body 32 can be of different shapes such as, square, rectangular, triangular, hexagonal, octagonal, elliptical, etc. Basin 38, and subsequently loop-type fastener 42 when adhered to basin 38, is at a depth that preferrably equals three-quarters of the distance from a tip of hook-type fastener 50 to rim 46 (as shown in FIG. 6C). However basin 38 can be at a depth to best accommodate hook-type fastener 28, and loop type fastener 42 can extend out of basin 38 to cover rim 36. Basin 38 is spherical segment in shape however basin 38 can be of any companion concave shape of head 12 enveloped by hook-type fastener 28. Loop-type fastener 42 is bonded to basin 38 by adhesive back 44A however loop-type fastener 42 can be secured to basin 38 by other methods such as, a rivet or rivets, a pressure creating O-ring, etc.

The inside circumference of rim 46A of loop-type fastener 42 is equal to the outside circumference of hook-type fastener 28 enveloping head 12 at a point three-quarters of the distance from tip of hook-type fastener 50 to rim 46 (as shown in FIG. 6C).

A orifice of basin 52 (as shown in FIG. 1B) is round in shape, however orifice 52 can be of different shapes such as, rectangular, square, triangular, any mirrored shape of hook-type fastener 28 enveloping head 12, etc. In various embodiments, loop-type fastener 42 lining basin 38 will maintain the same shape and depth as basin 38.

Disk body 32 is attached to a door by adhesive back 44B, however disk body 32 can be attached to a door by other methods such as, having a screw as an integral part, having a hole in the deepest part of basin 38 through which a screw can be inserted, a resin, a double sided tape, a silicone compound, etc.

Hook-type fastener 28 is bonded to head 12, and loop-type fastener 42 is bonded to basin 38 however, the fasteners are interchangeable in other embodiments of the invention.

In the preferred embodiment, door stop body 10 is typically 80 mm in length with wood screw body 30 of screw 20 extending from bottom 24 approximately 18 mm, totaling an overall length of approximately 98 mm. Hexagonal base 18 and flange 15 are equal at their widest dimension, the same being 18 mm. Door disk body 32 is typically 25 mm in diameter, has a depth from front rim 36 to bottom 40 of 12 mm, and the diameter of orifice of basin 52 is approximately 16 mm. In other embodiments the overall dimensions of the present invention can be increased or decreased proportionately to the size and weight of a door that the present invention is utilized with.

From the description above, a number of advantages of my invention, a door-holding door stop, become evident:

(a) The incorporation of a hook-and-loop material fastening system in my door-holding door stop is advantageous in that the hook-and-loop fastener provides a passive, effortless, non-complex, method of retaining a door in an open position.

(b) Another important concept of the device of my door-holding door stop, is the shaping of the hook-and-loop fastener to align the door stop and door disk easily, and at various angles, to retain a door in a fully open position.

(c) My door-holding door stop, as demonstrated, will prevent the door knob of a door from hitting and damaging a wall while the door is being pushed open, and the door stop, installed with the contributory door disk, functions to retain the door from self-closing.

(d) My door-holding door stop shows that when a door is pushed open toward a wall, the action of the door stop meeting the door disk combine, and as a result, produce a cushioning effect.

(e) The use of the hook-and-loop fastener, which is produced by numerous manufacturers in various colors and is readily available, as a component of my invention will obviate the need of additional production processes and thereby support environmental protection.

(f) The non-complex design of my door-holding door stop, which does not involve moving parts, manual manipulation, or an adjustment apparatus in order to be operable, and the use of commonly available materials, non-sophisticated machinery, parts, or technology in order to manufacture, makes my invention inexpensive to produce and therefore affordable.

(g) The semi-elliptic convex shape of the head of the door stop and the concave shape of the basin of the door disk, allow the door-holding function of my invention to perform at various angles.

(h) The use of only one screw allows for a simple and easy installation, and causes minimal defacing to a wall on which said invention is installed.

(i) The hexagon shaped base allows for secure gripping, while installing, with a variety of inexpensive hand tools that are readily available.

(j) The use of an adhesive back on the door disk, to secure the door disk to a door, eliminates the defacing of the door.

(k) When installing my door-holding door stop, the alignment of the door stop to the door disk is easily accomplished by securing the door stop to a wall, attaching the loop-type fastener lining the basin of the door disk to the hook-type fastener covering the head of the door stop, and gently pushing a door to meet the adhesive backed bottom of the door disk.

(l) The use of a hook-and-loop material fastening system allows for continued, dependable use of my door-holding door stop without diminishing its ability to function.

(m) With my door-holding door stop, there is no direct contact between the door stop and a door, thus eliminating any defacing of the door through continued use.

(n) The ease with which the hook-type fastener adheres to, or releases from, the loop-type fastener, in my door holding door stop, eliminates undo stress on a door or the door's hinges.

(o) My door-holding door stop cannot damage a door or itself when a person, being unaware of its installation, pulls the door away from a wall, in order to close the door.

(p) My door-holding door stop functions completely passively and therefore one can open or close a door it is installed with regardless of their age or physical capabilities. There are no additional exertions, efforts, or actions such as bending over, squatting, releasing two connected parts, or releasing any device from the door in order for a person to close the door.

(q) The effortless ease with which the hook-type fastener separates from the loop-type fastener cannot cause a personal injury when a person, being unaware of the installation of my door-holding door stop, pulls a door away from a wall in order to close the door.

(r) The elimination of sharp or pointed protrusions in the design of my door-holding door stop prevents the potential of snagging clothing or various personal injuries.

(s) Wall mounting of my door-holding door stop allows for unrestricted cleaning of the floor in the area of its installation.

(t) The variety of materials that can be used to manufacture my door-holding door stop and contributory door disk permit it to be produced in a variety of colors which will compliment the decor of a room in which the present invention is installed.

(u) My invention, a door-holding door stop, comprised of a door stop body and a contributory door disk, as demonstrated, has as a component a hook-and-loop material fastening system, and when installed to perform its function of a door stop and door holder, does so in such a manner that there is no noticeable resistance in releasing a door. A person can open and close a door with the ease, speed, and method one has become accustomed to, without the knowledge of my invention's existence or function. My door-holding door stop is not commercially orientated in appearance or bulk, and its aesthetic, and functional properties will compliment, rather than detract from, the area of installation.

PREFERRED EMBODIMENT—OPERATION

In accordance with my door-holding door stop, the reader can see that the present invention is multifunctional in operation and use, which are simple and straightforward.

My door-holding door stop functions in one manner by preventing a door knob, installed on a door, from contacting a wall when the door is pushed parallel, or at various angles toward the wall, into its fully opened position. In another manner the present invention functions to retain the door in a fully open position.

Inserting wood screw body 30 of screw 20, which extends from bottom 24 of hexagonal base 18 into a wall, secures door stop body 10 to the wall in a perpendicular position. Adhesive back 44B is bonded to door disk body 32 at bottom 40 by adhesive resin 54 and the adhesive back 44B is affixed to a door by applying pressure to front rim 36, and/or basin 38, thus securing adhesive back 44B, and consequently, door disk body 32 to the door. Hook-type fastener 28 enveloping and bonded to head 12 by adhesive back 44 is aligned, through installation, to engage loop-type fastener 42 lining and bonded to basin 38 by adhesive back 44A.

When one pushes a door toward a wall, loop-type fastener 42 lined basin 38 contacts hook-type fastener 28 covered head 12, thereby stopping the door at a distance short of the door's installed door knob contacting and damaging the wall. The length of body 10 (typically 80 mm) being sufficient to prevent the length of a door knob's protrusion from a door (typically less than 60 mm) from contacting a wall.

When a door is pushed parallel, or near parallel, to a wall in a fully opened position, the door is retained in that position, and, prevented from self-closing by hook-type fastener 28, bonded to head 12, engaging loop-type fastener 42, bonded to basin 38. The adherence of door stop head 12 to door disk basin 38 is created by the unique properties of the hook-and-loop fastener incorporated in the present invention.

FIG. 6C demonstrates three-quarters of hook-type fastener 28, as measured from tip of hook-type fastener 50 toward rim 46, enveloping and bonded to head 12, engaged with loop-type fastener 42 lining, and bonded to door disk basin 38. The allowance of only three-quarters of hook-type fastener 28 to engage basin 38 provides the necessary tolerance for my door-holding door stop to properly engage the door disk when they approach each other at various angles.

When making contact at various angles, hook-type fastener 28 enveloping and bonded to head 12 by adhesive back 44, is advantageously adapted to provide a maximum engagement with loop-type fastener 42, lining and bonded to basin 38 by adhesive back 44A, thereby retaining a door that the present invention is utilized with.

Disengagement of the door-holding door stop from the contributing door disk, in order to close a door, is an uneventful and simple matter of pulling the door away from a wall, which passively causes hook-type fastener 28 to separate from loop-type fastener 42.

CONCLUSIONS, RAMIFICATIONS, AND SCOPE

Accordingly, it is seen that, according to my invention, a door-holding door stop and contributory door disk arrangement is provided which can efficiently stop, and retain, a door in an economical, reliable, convenient, and simplified manner. Door stop body 10 and door disk body 32 can be manufactured from plastic, metal, wood, fibrous, rubber, and other materials, it has no moving or adjustable parts, they are installed easily with minimal damage to a wall and no damage or permanent defacing of a door, they are maintenance free, and my invention will not compromise a door's originally intended mode of operation.

In addition, my door-holding door stop's installation and function does not create an obstacle in the normal use of a door by children, the physically impaired, or the elderly. Furthermore, the various materials available for it's manufacture, the unique design, shaping and engaging of the structures, and the incorporation of the hook-and-loop material fastening system have the additional advantages in that (a) they permit the door-holding door stop and contributory door disk to be produced in various designs and colors, to complement a variety of decor;

(b) they permit the retaining of a door when the door approaches a wall at various angles;

(c) they permit for an easy, non-complicated and dependable method of installation;

(d) they permit for a non-complicated, and dependable method of aligning the hook-type fastening material covered door stop head 12 and the loop-type fastening material lined door disk basin 38 during installation;

(e) they provide for continued use without defacing a door, or causing undo stress on a door or the door's hinges;

(f) they allow for the invention to function with no resistance, thereby eliminating the potential for a personal injury, or damage to a door, wall, or floor;

(g) they provide no sharp or pointed protrusions extending from a door, thereby eliminating the potential for a personal injury, or the snagging or tearing of clothing;

(h) they allow for a door to be opened and closed at the accustomed speed;

(i) they allow for the invention to function completely passively, therefore eliminating further and unusual effort movement, bending, squatting, or manual manipulation to open or close a door;

(j) they allow for an installation and positioning that does not interfere with the cleaning of the area of installation.

Although the description above contains many specificities, these should not be construed as limiting the scope of my door-holding door stop but as merely providing illustrations of some of the presently preferred embodiments of this invention. Various other embodiments and ramifications are possible within it's scope. For example, the door stop body 10 can have other shapes, such as straight sided, square, triangular, tapered in a variety of ways, etc. The door stop head 12 can have different shapes such as, tube, pointed, rectangular, elliptical, mushroom, oblate, square, triangular, etc. The hexagonal base 18 can have other shapes such as, square, octagonal, triangular, etc.

The overall size of the door stop and door disk can be decreased, or increased, in direct proportion to the size and weight of various doors in, order to provide maximum performance.

In addition, the door disk body 32 can have other shapes such as, rectangular, square, hexagonal, octagonal, elliptical, elongated, double mounded, furrowed, etc. The door disk basin 38 can be of varied depths and of other shapes such as, square, triangular, or any inverted shape of the head of the door stop, etc. Door disk body 32 can, in other embodiments, be oblate and of various widths and depths, thereby eliminating basin 38.

Hook-type fastener 28 and loop-type fastener 42 can be affixed, respectively, to the door stop head 12 and the door disk basin 38 by other methods such as, rivets, collars, O-rings, pressure causing O-rings, etc. Hook-type fastener 28 and loop-type fastener 42 are interchangeable between the door stop head 12 and the door disk basin 38.

The door disk body 32 can be affixed to a door by other methods such as, nails, screws, staples, etc.

Thus the scope of the invention should be determined by the appended claims and their legal equivalents, rather than by the examples given.

What is claimed is:

1. A door stop comprising, in combination:

an elongated member having a substantially convex first end;

a covering for said first end of said elongated member wherein said covering comprises an exterior portion and an interior portion, said exterior portion comprises at least one of a hook-type and a loop-type fastening material;

means for attaching said first end of said elongated member to said interior portion of said covering;

means for attaching a second end of said elongated member to at least one of a wall and molding strip;

receiving means that is shorter than said elongated member for releasable coupling with said exterior portion of said covering, said receiving means comprises a substantially flat first side and a substantially concave second side;

a covering for said second side of said receiving means wherein said covering comprises an exterior portion and an interior portion, said exterior portion comprises at least one of a hook-type and a loop-type fastening material;

means for attaching said second side of said receiving means to said interior portion of said covering; and means for attaching said substantially flat first side of said receiving means to a face of a door.

2. A door stop in accordance with claim 1 wherein said elongated member comprises a rigid material.

3. A door stop in accordance with claim 1 wherein said means for attaching said second end of said elongated member to at least one of a wall and a molding strip comprises a single screw extending outward from said second end.

4. A door stop in accordance with claim 1 wherein said means for attaching said first side of said receiving means to a face of a door comprises an adhesive means bonded to said first side by a resin means.

5. A door stop in accordance with claim 1 wherein said elongated member and said receiving means are of a predetermined proportionate size to provide a stopping means and a retaining means for a door installed in a door opening.

* * * * *